United States Patent [19]

Minemura et al.

[11] 4,316,924

[45] Feb. 23, 1982

[54] SYNTHETIC FUR AND PROCESS FOR PREPARATION THEREOF

[75] Inventors: Norihiro Minemura, Takatsuki; Manabu Toyao, Ibaraki; Tsukasa Kobayashi; Mikio Tashiro, both of Matsuyama, all of Japan

[73] Assignee: Teijin Limited, Osaka, Japan

[21] Appl. No.: 129,667

[22] Filed: Mar. 12, 1980

[30] Foreign Application Priority Data

| | | | |
|---|---|---|---|
| Mar. 26, 1979 | [JP] | Japan | 54-34216 |
| Aug. 20, 1979 | [JP] | Japan | 54-104936 |
| Sep. 26, 1979 | [JP] | Japan | 54-122528 |
| Oct. 15, 1979 | [JP] | Japan | 54-131782 |
| Jan. 24, 1980 | [JP] | Japan | 55-6291 |
| Jan. 28, 1980 | [JP] | Japan | 55-7715 |
| Feb. 4, 1980 | [JP] | Japan | 55-11430 |

[51] Int. Cl.[3] ..... B32B 3/02; D02G 3/00

[52] U.S. Cl. ..... 428/89; 428/88; 428/97; 428/359; 428/362; 428/370; 428/371; 428/397; 428/398; 428/399

[58] Field of Search ..... 428/398, 399, 397, 370, 428/373, 374, 369, 371, 89, 97, 88, 359, 362; 28/160, 162

[56] References Cited

U.S. PATENT DOCUMENTS

| | | | |
|---|---|---|---|
| 2,255,779 | 9/1941 | Kent | 428/89 |
| 2,737,702 | 3/1956 | Schmidt et al. | 428/89 |
| 2,815,558 | 12/1957 | Bartovics | 428/97 |
| 3,117,906 | 1/1964 | Tanner | 428/397 |
| 3,185,613 | 5/1965 | Adams | 428/399 |
| 3,418,200 | 12/1968 | Tanner | 428/373 |
| 3,914,488 | 10/1975 | Gorrafa | 428/397 |
| 3,930,106 | 12/1975 | Mihara et al. | 428/97 X |
| 4,075,378 | 2/1978 | Anton et al. | 428/97 |
| 4,118,534 | 10/1978 | Stanley | 428/370 |
| 4,201,813 | 5/1980 | Brumlik | 428/97 |

*Primary Examiner*—Lorraine T. Kendell

*Attorney, Agent, or Firm*—Burgess, Ryan and Wayne

[57] ABSTRACT

A synthetic fur closely resembling a natural fur comprises relatively long and thick guard hair-like raised synthetic fibers, each having a transverse cross-section wherein at least one constricted part is formed, and underfur-like raised synthetic fibers, each having a rate of dissolution in a solvent or of hydrolysis with a hydrolyzing agent higher than that of said guard hair-like raised fibers, and a length and fineness less than those of said guard hair-like raised fibers. The synthetic fur is prepared by applying a viscous treating liquid containing a solvent or hydrolyzing agent to a raised surface of a fabric comprising relatively thick raised synthetic fibers, each having a transverse cross-section wherein at least one constricted part is formed, and relatively fine raised synthetic fibers, each having a rate of dissolution in the solvent or of hydrolysis with the hydrolyzing agent higher than that of said relatively thick raised fibers.

11 Claims, 38 Drawing Figures

SYNTHETIC FUR AND PROCESS FOR PREPARATION THEREOF

BACKGROUND OF THE INVENTION

1. Field of the Invention

The invention relates to a synthetic fur comprising raised synthetic fibers and a process for the preparation thereof.

2. Description of Prior Art

Natural furs generally comprise a hairy covering over the skin, which consists of fine, short and dense underfur (or fur fibers) providing the thermal insulation, and thick, long guard hair (or overhair) having tapered ends and forming a protective surface. As wearing apparel, natural furs are prized not only for their beauty and warmth but also as a mark of social standing.

Attempts have hitherto been made to provide synthetic furs resembling natural furs. Particularly, a process disclosed in Japanese Patent Publication No. 48-4910 can provide a synthetic fur which fairly well resembles natural furs. This process comprises forming a pile fabric having piles consisting of two or more types of polyester fibers different in solubility in an alkali and dipping the end portions of the piles into an aqueous alkali solution to effect hydrolysis at the dipped end portions, thereby producing piles having tapered ends and being different in length. However, the synthetic fur obtained by this process is still unsatisfactory in surface feel to hands, softness, appearance and the like.

SUMMARY OF THE INVENTION

It has been found that a synthetic fur having a surface feel to hands, softness and appearance closely resembling those of natural furs can be obtained by the use of fibers with a specific transverse cross-sectional shape as the guard hair-like raised synthetic fibers in a synthetic fur, such as proposed in the above-mentioned Japanese Patent Application No. 48-4910.

Thus, the present invention provides a synthetic fur comprising relatively long and thick guard hair-like raised synthetic fibers, each having a transverse cross-section wherein at least one constricted part is formed, and underfur-like raised synthetic fibers, each having a rate of dissolution in a solvent or of hydrolysis with a hydrolyzing agent higher than that of said guard hair-like raised synthetic fibers, and a length and fineness less than those of said guard hair-like raised synthetic fibers.

According to the present invention, there is also provided a process for preparing a synthetic fur, which comprises applying a viscous treating liquid, containing a solvent or hydrolyzing agent and having a viscosity of 1,000 to 15,000 c.p., to a raised surface of a fabric comprising relatively thick raised synthetic fibers, each having a transverse cross-section wherein at least one constricted part is formed, and relatively fine raised synthetic fibers, each having a rate of dissolution in the solvent or of hydrolysis with the hydrolyzing agent higher than that of said relatively thick raised synthetic fibers, and then, optionally, subjecting the fabric to heat treatment to produce raised fibers different in length.

DESCRIPTION OF PREFERRED EMBODIMENTS

The synthetic fibers usable for the raised fibers in the present invention include polyester fibers, polyamide fibers, polyacrylonitrile fibers and the like. Among them, polyester fibers and polyamide fibers are preferred. The polyester fibers may be made preferably of a polyester having ethylene terephthalate units as its main repeating units, especially of polyethylene terephthalate. However, there may also be employed an ethylene terephthalate copolymer containing a copolymerized third component such as isophthalic acid, 5-sulfo-isophthalic acid, methoxy polyoxyethylene glycol or the like. The polymerization degree of the polyester may vary depending on the type of the polyester employed, the desired shape of the transverse cross-section of the resulting fiber and the like. However, in the case of polyethylene terephthalate, in general, it should preferably have an intrinsic viscosity [$\eta$] of 0.4 to 0.7, as measured using an O-chlorophenol solution at 35° C. The polyamide fibers may include fibers made of nylon 6, nylon 66, aromatic polyamides and the like.

Figure 1A:
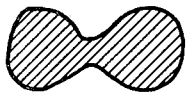
FIGS. 1A to 1S are schematic views illustrating the transverse cross-sections of synthetic fibers usable for the guard hair-like raised fibers in the synthetic fur according to the present invention.
Figure 1S:
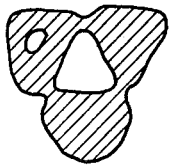
Figure 2A:
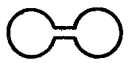
FIGS. 2A to 2S schematically illustrate the shapes of the orifices of spinnerets useful for spinning the synthetic fibers shown in FIGS. 1A to 1S.
Figure 2B:
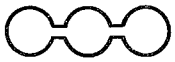
Figure 2C:
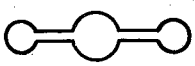

In the present invention, the synthetic fibers employed as the guard hair-like raised fibers have a transverse cross-section having at least one constricted part. Examples of such transverse cross-sections are schematically illustrated in FIGS. 1A to 1S. These fibers can respectively be obtained using the spinnerets having orifices of the shapes as illustrated in FIGS. 2A to 2S. It is desirable that the guard hair-like raised fibers have a fineness of 10 to 100 deniers, preferably 20 to 70 deniers, especially 30 to 50 deniers.

On the other hand, the underfur-like raised synthetic fibers may have a circular or conventionally modified cross-section. They may desirably have a fineness of 0.1 to 10 deniers, preferably 0.1 to 6 deniers.

The synthetic fur according to the present invention may be prepared by forming a fabric comprising on its surface relatively thick raised synthetic fibers, each having a transverse cross-section wherein at least one constricted part is formed, and relatively fine raised synthetic fibers, each having a rate of dissolution in a solvent or of hydrolysis with a hydrolyzing agent higher than that of the relatively thick raised synthetic fibers. Such a fabric can be formed, for example, by flocking a woven, knitted or non-woven fabric with the above-mentioned two types of synthetic fibers, knitting the fibers into a pile fabric, subjecting the fibers to sliver knitting, or weaving the fibers into a stitched double fabric and cutting the stitching threads to form two pile fabrics. It is desirable that the raised fibers exist in the resultant fabric at a density of 3,000 to 15,000 per $cm^2$ and have a length of 10 to 50 mm.

The resultant fabric may then be subjected, if desirable or necessary, to backing, brushing, polishing or shearing. Particularly, polishing is effective to stretch the end portions of the raised fibers under a heated condition, which is advantageous to remove the crimps of the raised fibers. The polishing may suitably be effected at a temperature of up to 150° to 250° C.

Then, the fabric is subjected to the surface treatment, which comprises applying a viscous treating liquid containing a solvent or hydrolyzing agent to the raised surface of the fabric. As the solvent or hydrolyzing agent, there may be used:

(1) in the case of polyamide fibers, sulfuric acid, hydrochloric acid, formic acid, phenol, m-cresol and dimethyl sulfoxide;

(2) in the case of polyester fibers, a chloroform-phenol mixture, O-chlorophenol, sodium hydroxide, potassium hydroxide and sodium carbonate; and, (3) in the case of polyacrylonitrile fibers, dimethylformamide, dimethyl sulfoxide, dimethylacetamide, sulfuric acid, malonitrile, ethylene carbonate and anhydrous succinic acid.

The amount of the solvent or hydrolyzing agent used is not critical and may vary depending on the type, cross-sectional shape, fineness or the like of the employed synthetic fibers. In the case where an alkali metal compound is used for the hydrolysis of polyester fibers, it is desirable to use a quaternary ammonium salt such as lauryl-dimethylbenzylammonium chloride or cetyl-dimethylbenzylammonium chloride as a hydrolysis-promoting agent.

In the present invention, the guard hair-like raised fibers and the underfur-like raised fibers may be produced using different types of fibers in combination. For example, polyester fibers and polyamide fibers may be used in combination, while formic acid, phenol or dimethyl sulfoxide is used as the solvent, to produce the guard hair-like raised fibers consisting of the undissolved polyester fibers and the underfur-like raised fibers consisting of the partially dissolved and thus shortened polyamide fibers. In this combined use of polyester and polyamide fibers, if sodium hydroxide or sodium carbonate is used as the hydrolyzing agent, only the polyester fibers are hydrolyzed at their end portions to shorten the fiber lengths. Likewise, polyacrylonitrile fibers may be used in combination with polyester fibers or polyamide fibers.

Further, the guard hair-like raised fibers may also be produced using the same types of fibers in combination. For example, polyethylene terephthalate fibers may be used in combination with polyester fibers consisting of an ethylene terephthalate polymer containing a copolymerized or blended third component and having a higher hydrolysis rate. In this combination, if sodium hydroxide or sodium carbonate is used as the hydrolyzing agent, a difference in length may be produced between the polyethylene terephthalate fibers and the other polyester fibers due to the difference in their hydrolysis rates.

The surface treatment of the formed fabric is carried out by applying a viscous treating liquid having a viscosity of 1,000 to 15,000 c.p. to a raised surface of the fabric. If the viscosity of the treating liquid is lower than 1,000 c.p., the treating liquid has excessive fluidity and, thus, it is difficult to restrain the dissolution or hydrolysis of the raised fibers to the end portions since the treating liquid applied to the raised surface flows down rapidly to the base portions of the raised fibers. If the viscosity is higher than 15,000 c.p., it is difficult to uniformly apply the treating liquid to the raised surface. Preferably, the treating liquid has a viscosity of 3,000 to 8,000 c.p.

The viscosity of the treating liquid can be regulated by adding thereto a natural, semi-synthetic or synthetic thickener such as wheat starch, rice bran, tragacanth gum, sodium alginate, locust bean gum, methyl cellulose, carboxymethylcellulose, polyvinyl alcohol, polyvinyl acetate, polysodium acrylate or the like. The viscous treating liquid may be applied to the raised surface in a conventional manner, for example, by a knife coating, gravure coating, flat screen or rotary screen technique.

When the treating liquid is applied to the raised surface of the fabric, the solvent or hydrolyzing agent contained in the treating liquid dissolves or hydrolyzes the end portions of the raised fibers not only to shorten their lengths, but also to make the end portions finer. If the fabric is placed so that the raised surface to which the treating liquid is applied is positioned upward, the treating liquid flows down slowly toward the middle or base portions of the raised fibers so that the deposited amount of the treating liquid is the largest at the ends and gradually decreases toward the middle or base portions. Thus, the end portions of the raised fibers are tapered and, in some cases, the end portions are divided into plural fibers at the constricted part or parts in each of their transverse cross-sections. If the raised fibers have preliminarily been wetted with water, such tapering effect can more easily be obtained. On the other hand, if the fabric is placed so that the raised surface applied with the treating liquid is positioned downward, the treating liquid is deposited at the ends of the raised fibers so that only the fiber ends are tapered and, optionally, divided.

The dissolution or hydrolysis of the raised fibers may be accelerated by subjecting the fabric having the treating liquid applied to its raised surface to heat treatment. The heat treatment may advantageously make it possible to decrease the treating time and to carry out the treatment continuously. The heat treatment may be carried out in a conventional manner, for example, by heating the fabric in dry air at 130° to 200° C. for 30 seconds to 20 minutes, in saturated steam at 100° to 130° C. for 5 to 40 minutes, or in superheated steam at 130° to 200° C. for 5 to 30 minutes. The heat treatment in saturated steam is particularly preferred.

After the completion of the partial dissolution or hydrolysis of the raised fibers, the fabric may be washed and dried in a conventional manner. If desirable, the raised fibers of the resultant fabric may further be coated with a silicone polymer. This treatment may be very advantageous to obtain a synthetic fur having a hand closely resembling that of a natural fur. The silicone polymer coating can be applied to the raised fiber surfaces by treating the raised fibers with a mixture of a polyepoxide and an aminosiloxane, an epoxysiloxane and a polyamine, or an epoxysiloxane and an aminosilane, and curing the silicone polymer on the fiber surfaces. Further, the fabric may optionally be subjected to back coating with an urethane resin, rubber or the like.

Figure 1B:
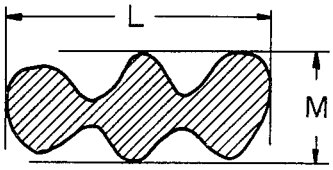
Figure 1C:
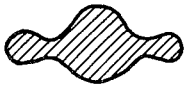

In the present invention, the relatively thick raised synthetic fibers constituting the guard hair-like raised fibers may preferably have a flat transverse cross-section with a flatness ratio of not less than 1.2, as illustrated in FIGS. 1A to 1K. The use of such flat fibers as the guard hair-like raised fibers may advantageously produce a synthetic fur having an excellent surface feel to the touch, softness and appearance which closely resemble those of a natural fur. Preferably, the flatness ratio is not more than 12, particularly not more than 6. The "flatness ratio" as used herein is defined by L/M wherein L is the length of the maximum major axis of the fiber and M is the length of the maximum minor axis, as illustrated in FIG. 1B.

Further, the relatively thick raised fibers having a flat transverse cross-section may be composite fibers made of two or more components. For example, if the constricted parts of the fibers, as illustrated in FIGS. 1A to 1E or in FIGS. 1F to 1K, are composed of a first polymer which has a higher rate of dissolution in a solvent or of hydrolysis with a hydrolyzing agent, while the non-constricted parts are composed of a second polymer having a lower rate of the dissolution or hydrolysis, the raised fiber can easily be divided into two or more fibers at their end portions by dissolving or hydrolyzing the first polymer.

At least some of the relatively thick raised synthetic fibers may consist of hollow fibers each having a transverse cross-section in which at least one hole is formed at the non-constricted part or parts, as illustrated in FIGS. 1F to 1K and FIGS. 1P to 1S. The use of the hollow fibers as a part of the guard hair-like raised fibers may also be advantageous for the production of a synthetic fur excellent in hand and appearance. particularly, the use of such hollow fibers in combination with non-hollow fibers may produce guard hair-like raised fibers of a tone-in-tone color shade when they are dyed.

The relatively fine raised synthetic fibers constituting the underfur-like raised fibers may be made of a polyester containing $-SO_3Me$ groups in which Me is a metal atom. A typical example of such polyesters is a polyester containing 1 to 15% by mole of copolymerized units:

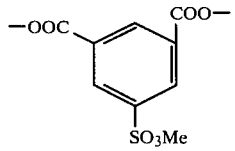

However, it should be understood that the term "polyester containing $-SO_3Me$ groups", as used herein, includes copolyesters containing a copolymerized third component having a $-SO_3Me$ group, as well as polyester compositions blended with a compound having a $-SO_3Me$ group such as a metal salt of an alkyl sulfonic acid or alkylphenyl sulfonic acid. The polyester containing $-SO_3Me$ groups has a very high hydrolysis rate and a modified dyeability, i.e. it can be dyed with disperse dyes and with cationic dyes. Thus, if the polyester fibers containing $-SO_3Me$ groups are employed as the relatively fine raised fibers, the underfur-like raised fibers having relatively short lengths can easily be produced and, in addition, the underfur-like raised fibers can easily be dyed in a color shade different from the color shade of the guard hair-like raised fibers.

A majority of the underfur-like raised fibers may have three-dimensional crimps. The use of such crimped fibers can provide an excellent synthetic fur having good covering effect and heat retaining property. In the case where the raised fibers having three-dimensional crimps constitute more than 50%, preferably 50 to 80%, by weight of the underfur-like raised fibers, excellent feel to the touch, softness and appearance can be obtained in the resultant synthetic fur. The crimped fibers may be obtained from fibers having potential crimpability, such as false-twisted crimping fibers, composite crimping fibers, edged crimping fibers, structural crimping fibers and the like. Among them, composite crimping fibers of a side-by-side type or sheath and core type are particularly preferred.

Further, if desirable, the non-raised surface (i.e. reverse side surface) of the synthetic fur according to the present invention may be subjected to flocking. The flocking may be carried out by applying an adhesive to the reverse side surface, and then, spreading an fixing flock thereonto.

The present invention will further be illustrated with reference to the following illustrative, but not limitative, examples.

EXAMPLE 1

Figure 1D:
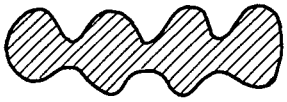
Figure 1E:
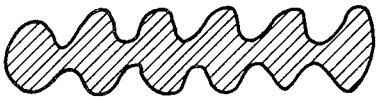
Figure 1F:
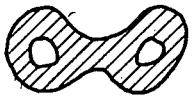
Figure 1G:
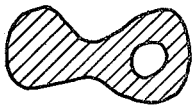
Figure 1H:
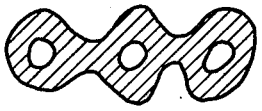
Figure 1I:
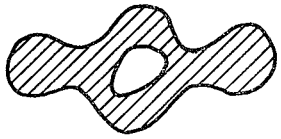
Figure 1J:
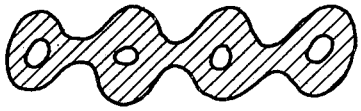
Figure 1K:
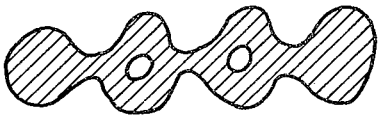
Figure 2D:
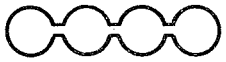
Figure 2E:
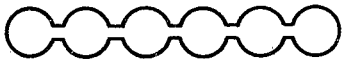
Figure 2F:
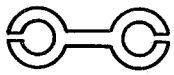
Figure 2G:
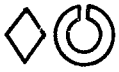
Figure 2H:
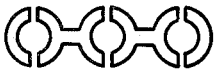
Figure 2I:
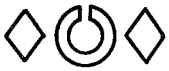
Figure 2J:
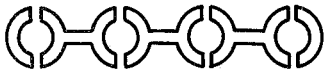
Figure 2K:
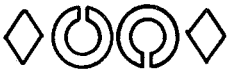

Polyethylene terephthalate having an intrinsic viscosity of 0.60, as measured in an o-chlorophenol solution at 35° C., was made molten at 305° C., spun from a spinneret having 50 orifices, as illustrated in FIG. 2D, and taken up at 700 m/min. The diameter of each of the main holes of each orifice was 0.3 mm and the width and length of each of the slits connecting the main holes were 0.06 mm and 0.15 mm, respectively. The spun filaments were put together and drawn in warm water of 70° C., at a draw ratio of 3.8, into a tow having a monofilament fineness of 16 deniers. This tow was textured on a stuffing box type texturing machine and then cut into staple fibers 50 mm long. The resultant staple fibers had a cross-sectional shape as illustrated in FIG. 1D and a flatness ratio of 4.2.

The staple fibers were blended with staple fibers (circular cross-section, monofilament fineness of 3 deniers, fiber length of 51 mm) made of an ethylene terephthalate polymer containing 5% by mole of copolymerized polyoxyethylene glycol (molecular weight of 600) at a ratio of 40:60. The blended fibers were carded and formed into a sliver of 100 grains and the sliver was knitted into a tubular fabric on a sliver knitting machine, using a polyester spun yarn of 14S/l as the back thread. The tubular fabric was opened to form a pile fabric which was then subjected to back coating with an acrylic resin and heated at 120° C. to fix the piles (raised fibers). The fabric was subjected to shearing to cut the piles to lengths of about 20 mm and then, to polishing three times, first at 200° C., second at 160° C. and third at 120° C., to remove the crimps of the piles. Then, the fabric was again subjected to shearing to cut the raised fibers to lengths of 20 mm and the raised fibers were dressed. The density of the raised fibers in the obtained fabric was 6,500 per $cm^2$.

Onto the raised surface of the obtained fabric, an aqueous treating liquid containing 30% caustic soda and 2.5% sodium alginate, and having a viscosity of 3,000 C.P., was coated by a screen technique. The deposited amount of the treating liquid was 1.2 $g/cm^2$. The coated fabric was, without being dried, steamed in a steamer at 100° C. for 20 minutes, and then, washed with water and dried.

Thus, a synthetic fur comprising long and thick guard hair-like raised fibers, and short and fine underfur-like raised fibers was obtained. A majority of the guard hair-like raised fibers had end portions divided into four fibers and the individual raised fibers had tapered ends. The synthetic fur was soft to the touch and had an appearance resembling a natural fur.

EXAMPLE 2

Figure 1L:
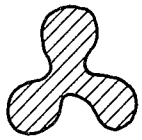
Figure 1M:
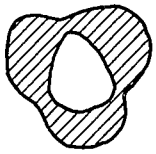
Figure 1N:
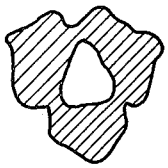
Figure 1O:
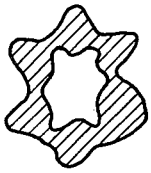
Figure 1P:
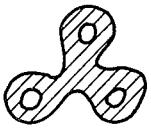
Figure 1Q:
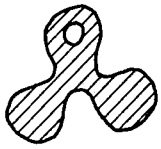
Figure 1R:
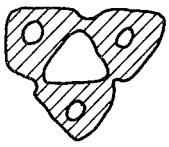
Figure 2L:
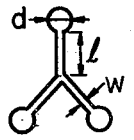
Figure 2M:
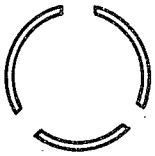
Figure 2N:
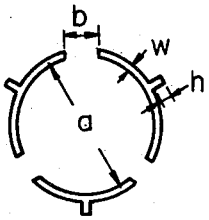
Figure 2O:
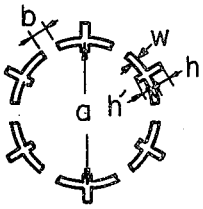
Figure 2P:
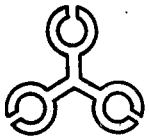
Figure 2Q:
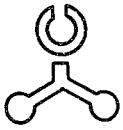
Figure 2R:
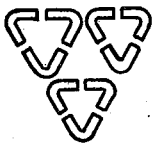
Figure 2S:
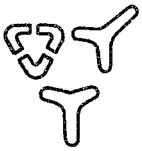

Polyethylene terephthalate having an intrinsic viscosity of 0.60, as measured in an o-chlorophenol solution at 35° C., was made molten at 305° C., spun from a spinneret having 50 orifices, as illustrated in FIG. 2L, 2N and 2O, and taken up at 700 m/min. In the orifices as illustrated in FIG. 2L, the diameter d of the main holes was 0.3 mm, the width w of the slits was 0.06 mm and the length l of the slits was 0.25 mm; in the orifices as illustrated in FIG. 2N, the diameter a was 1.0 mm, the distance b was 0.25 mm, the width w was 0.08 mm and the length h was 0.08 mm; and, in the orifices as illustrated in FIG. 2O, the diameter a was 1.2 mm, the distance b was 0.15 mm, the width w was 0.06 mm, the length h was 0.30 mm and the length h' was 0.08 mm. The spun filaments were put together and drawn in warm water of 70° C., at a draw ratio of 3.5 in the case of the filaments spun from the orifices as illustrated in FIG. 2L, 4.0 in the case of the filaments spun from the orifices as illustrated in FIG. 2N and 4.2 in the case of the filaments spun from the orifices as illustrated in FIG. 2O, to obtain a tow having a monofilament fineness of 16, 23 and 25 deniers, respectively. This tow was textured on a stuffing box type texturing machine and, then, cut into staple fibers 51 mm long. The resultant staple fibers had a cross-sectional shape as illustrated in FIG. 1L, 1N and 1O, respectively.

The staple fibers were blended with staple fibers (circular cross-section, monofilament fineness of 2 deniers, fiber length of 51 mm) made of an ethylene terephthalate polymer containing 3.2% by mole of copolymerized 5-sulfoisophthalic acid at a ratio of 40:60. The blended fibers were carded and formed into a sliver of 100 grains. The sliver was knitted into a tubular fabric on a sliver knitting machine, using as the back thread a polyester spun yarn of 14S/L1, in which highly contracting polyester fibers were blended in an amount of 40%. The tubular fabric was opened to form a pile fabric which was then subjected to back coating with an acrylic resin and heated at 120° C. to fix the piles. The fabric was subjected to shearing to cut the piles to lengths of about 20 mm and, then, to polishing three times, first at 200° C., second at 160° C., and third at 120° C., to remove the crimps of the piles. Then, the fabric was again subjected to shearing to cut the raised fibers to lengths of 20 mm and the raised fibers were dressed. The density of the raised fibers in the obtained fabric was 7,500 per $cm^2$.

Onto the raised surface of the obtained fabric, an aqueous treating liquid containing 25% of caustic soda and 5% of lauryl-dimethylbenzylammonium chloride and 2.5% of sodium alginate, and having a viscosity of 6,000 C.P., was coated by a screen technique. The deposited amount of the treating liquid was 1.2 g/$cm^2$. The coated fabric was, without being dried, steamed in a steamer at 100° C. for 20 minutes, and then, washed with water and dried.

Thus, a synthetic fur comprising long and thick guard hair-like raised fibers, and short and fine underfur-like raised fibers was obtained. The synthetic fur was soft to the touch and had an appearance resembling a natural fur. A majority of the guard hair-like raised fibers had end portions divided into three fine fibers of circular cross-sections in the case of the fibers as illustrated in FIG. 1L, divided into three fine fibers of triangular cross-section in the case of the fibers as illustrated in FIG. 1N, and divided into six fine fibers of triangular cross-sections in the case of the fibers as illustrated in FIG. 10, and the individual raised fibers had tapered ends.

EXAMPLE 3

In an analogous manner to that described in Example 1, except that the spun filaments were taken up at 600 m/min., drawn at a draw ratio of 3.3 and cut into staple fibers of 64 mm long, staple fibers having a monofilament fineness of 30 deniers and having a cross-sectional shape as illustrated in FIG. 1D and a flatness ratio of 4.5 were obtained (referred to as staple fibers A).

Modified polyethylene terephthalate containing 2.0% by mole of copolymerized sodium 3,5-di-(carboxy)-benzene-sulfonate and having an intrinsic viscosity of 0.50, as measured in an o-chlorophenol solution at 35° C., was made molten at 310° C., spun from a spinneret having 300 circular orifices with a diameter of 0.3 mm and taken up at 600 m/min. The spun filaments were put together and drawn in warm water of 70° C., at a draw ratio of 4.3, to form a tow of a monofilament fineness of 2 deniers. The tow was textured on a stuffing box type texturing machine and, then, cut into staple fibers 38 mm long (referred to as staple fibers B).

The above-mentioned two types of staple fibers A and B were blended at a ratio of 30:70. Then, the blended fibers were further processed as described in Example 1 to obtain a natural fur-like fabric, except that the density of the raised fibers in the obtained fabric was 9,000 per $cm^2$.

The obtained fabric was immersed into an emulsion containing 1% by weight of a mixture of 72 parts by weight of an epoxy-siloxane consisting essentially of units:

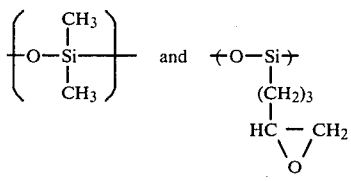

having an epoxidation degree of 1% by weight, and having $—Si(CH_3)_3$ groups in both terminals and 6 parts by weight of an aminosilane having the structure:

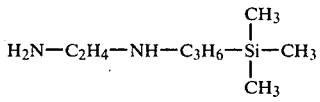

After squeezing and drying, the fabric was subjected to curing at 140° C. for 1 minute.

Thus, a synthetic fur having a configuration similar to that obtained in Example 1 was obtained. The synthetic fur had a softness and appearance closely resembling those of a natural fur.

EXAMPLE 4

Modified polyethylene terephthalate containing 7.5% by weight of copolymerized polyoxyethylene glycol of a molecular weight of 1,000 and having an intrinsic viscosity of 0.63, as measured in an o-chlorophenol solution at 35° C., was made molten at 300° C., spun from a spinneret having 50 orifices as illustrated in FIG. 2B and taken up at 600 m/min. In each orifice, the diameter of the main holes was 0.35 mm and the width and length of the slits connecting the main holes were 0.08 mm and 0.15 mm, respectively. The spun filaments were put together and drawn in warm water of 60° C., at a draw ratio of 3.5, to form a tow. The tow was then heat treated at 200° C. under tension, textured on a stuffing box type texturing machine and cut into staple fibers 64 mm long. The obtained staple fibers had a monofilament fineness of 30 deniers, a cross-sectional shape as illustrated in FIG. 1B and a flatness ratio of 3.0 (referred to as staple fibers C).

The staple fibers C were blended with the staple fibers B described in Example 3 at a ratio of 35:65. Then, the blended fibers were further processed as described in Example 3 and, thus, a synthetic fur similar to that of Example 3 was obtained. A majority of the guard hair-like raised fibers had end portions divided into three fibers and the ends of the individual raised fibers were tapered.

EXAMPLE 5

Polyethylene terephthalate containing 5% by weight of copolymerized polyoxyethylene glycol (molecular weight of 600) and having an intrinsic viscosity of 0.60, as measured in an o-chlorophenol solution at 35° C., was made molten at 300° C., spun from a spinneret having 50 orifices as illustrated in FIG. 2H and taken up at 700 m/min. In each orifice, the width of each of the slits was 0.06 mm. The spun filaments were put together and drawn in warm water of 70° C., at a draw ratio of 3.8, to obtain a tow of a monofilament fineness of 16 deniers. The tow was textured on a stuffing box type texturing machine and, then, cut into staple fibers 51 mm long. The resultant staple fibers had a cross-sectional shape as illustrated in FIG. 1H.

The staple fibers were blended with staple fibers (circular cross-section, monofilament fineness of 3 deniers, fiber length of 51 mm) made of an ethylene terephthalate polymer containing 2.0% by mole of copolymerized sodium di-(carboxy)-benzenesulfonate at a ratio of 30:70. Then, the blended fibers were further processed as mentioned in Example 1.

The steamed and water-washed fabric was then, without being dried, dyed in a conventional manner, using disperse dyes and cationic dyes, into a beige shade in the guard hair-like raised fibers and a deep brown shade in the underfur-like raised fibers. Onto the reverse side surface of the fabric, a solution of a polyurethane in dimethylformamide (containing 15% by weight of the polyurethane) was coated using a gravure coater to a coverage of 10 g/m$^2$ and, then, the polyurethane was coagulated in water. Then, an emulsion of a polysiloxane was applied onto the raised surface of the fabric to a coverage of 0.2 g/m$^2$ and the fabric was dried.

Thus, a synthetic fur comprising long and thick guard hair-like raised fibers, and short and fine underfur-like raised fibers was obtained. A majority of the guard hair-like raised fibers had end portions divided into three fibers and the individual guard hair-like raised fibers had a luster inherent to hollow fibers. The synthetic fur had a softness and appearance closely resembling those of a natural fur.

EXAMPLE 6

Nylon 6 (polycaprolactam) having an intrinsic viscosity of 1.1, as measured in a m-cresol solution, was made molten at 270° C., spun from a spinneret which was the same as that used in Example 1 and taken up at 600 m/min. The spun filaments were put together and drawn, while jetting steam, at a draw ratio of 3.0, to form a tow. The tow was textured on a stuffing box type texturing machine and cut into staple fibers 64 mm long. The obtained staple fibers had a monofilament fineness of 50 denier, a cross-sectional shape as illustrated in FIG. 1D and a flatness ratio 4.5.

The obtained staple fibers were blended with the staple fibers B described in Example 3 at a ratio of 25:75. Then, the blended fibers were further processed as mentioned in Example 3.

Thus, there was obtained a synthetic fur similar to that obtained in Example 3, but having softer guard hair-like raised fibers.

EXAMPLE 7

Polyethylene terephthalate staple fibers were prepared as described in Example 3 for the preparation of the staple fibers A.

A blend of modified polyethylene terephthalate containing 2.0% by mole of copolymerized sodium 3,5-di-(carboxy)-benzenesulfonate and having an intrinsic viscosity of 0.50, as measured in an o-chlorophenol solution at 35° C., with 1% by weight of sodium ($C_{14}$)-alkylsulfonate was processed as described in Example 3 for the preparation of the staple fibers B to obtain modified polyethylene terephthalate staple fibers.

Then, the above mentioned two types of staple fibers were further processed as described in Example 3. Thus, a synthetic fur similar to that obtained in Example 3 was obtained. In this synthetic fur, about 20% of the guard hair-like raised fibers had end portions divided into four fibers.

EXAMPLE 8

Two types of modified polyethylene terephthalate containing 3.0% by mole of copolymerized sodium 3,5-di-(carboxy)-benzenesulfonate and respectively having intrinisc viscosities of 0.50 and 0.38, as measured in an o-chlorophenol at 35° C., were separately made molten, spun together, while conjugating them side-by-side at a ratio of 1:1, from a spinneret having circular orifices with a diameter of 0.3 mm, and taken up at 600 m/min. The spun filaments were put together and drawn in warm water of 70° C., at a draw ratio of 4.0, to form a tow. The tow was then relaxed at 110° C. for 5 minutes to generate gentle three-dimensional crimps and cut into staple fibers 51 mm long to provide staple fibers of a monofilament fineness of 2 deniers.

The obtained staple fibers were blended with the staple fibers A described in Example 3 at a ratio of 65:35 and the blended fibers were further processed as described in Example 3. Thus, a synthetic fur similar to that obtained in Example 3, but having more excellent covering effect and heat retaining property, was obtained.

EXAMPLE 9

Nylon 6 staple fibers described in Example 6 were blended with composite crimping staple fibers as described in Example 8 at a ratio of 40:60. Then, the blended fibers were further processed as described in Example 3. Thus, a synthetic fur similar to that obtained in Example 8 was obtained.

We claim:

1. A synthetic fur comprising relatively long and thick guard hair-like raised synthetic fibers, each having a transverse cross-section wherein at least one constricted part is formed, the end portions of a majority of said guard hair-like raised synthetic fibers being divided into plural fibers at the constricted part or parts in each of their transverse cross-sections, and underfur-like raised synthetic fibers, each having a rate of dissolution in a solvent or of hydrolysis with a hydrolyzing agent higher than that of said guard hair-like raised synthetic fibers, and a length and fineness less than those of said guard hair-like raised synthetic fibers.

2. A synthetic fur as claimed in claim 1, wherein said guard hair-like raised synthetic fibers each has a flat transverse cross-section of a flatness ratio of not less than 1.2.

3. A synthetic fur as claimed in claim 1 or 2, wherein at least some of said guard hair-like raised synthetic fibers have at least one hole at the non-constricted part or parts in the transverse cross-section to form a hollow fiber.

4. A synthetic fur as claimed in claim 1 or 2, wherein said guard hair-like raised synthetic fibers are made of polyester.

5. A synthetic fur as claimed in any one of claims 1 or 2, wherein said guard hair-like raised synthetic fibers are made of polyamide.

6. A synthetic fur as claimed in claim 1 or 2, wherein said underfur-like raised synthetic fibers are made of polyester.

7. A synthetic fur as claimed in claim 6, wherein said polyester underfur-like raised synthetic fibers contain $-SO_3Me$ groups in which Me is a metal atom.

8. A synthetic fur as claimed in claim 1 or 2, wherein not less than 50% of said underfur-like raised synthetic fibers have three-dimensional crimps.

9. A synthetic fur as claimed in claim 8, wherein said underfur-like raised synthetic fibers having three-dimensional crimps are composite fibers.

10. A synthetic fur as claimed in claim 1, wherein at least some of said guard hair-like raised synthetic fibers have at least one hole at the non-constricted part or parts in the transverse cross-section to form a hollow fiber.

11. A synthetic fur as claimed in claim 1 wherein the guard hair-like raised synthetic fibers are made from polymers selected from the group consisting of polyester and polyamide.

* * * * *